US008807958B2

(12) United States Patent
Sidlyarevich et al.

(10) Patent No.: US 8,807,958 B2
(45) Date of Patent: Aug. 19, 2014

(54) ELECTRONIC CAMSHAFT MOTOR CONTROL FOR PISTON PUMP

(75) Inventors: Timothy Sidlyarevich, Rogers, MN (US); James Campbell, Plymouth, MN (US); John A. Metza, Eagan, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 688 days.

(21) Appl. No.: 12/442,782

(22) PCT Filed: Sep. 25, 2007

(86) PCT No.: PCT/US2007/079436

§ 371 (c)(1),
(2), (4) Date: Mar. 25, 2009

(87) PCT Pub. No.: WO2008/039787

PCT Pub. Date: Apr. 3, 2008

(65) Prior Publication Data

US 2010/0034666 A1 Feb. 11, 2010

(51) Int. Cl.
*F04B 43/12* (2006.01)
*F04B 11/00* (2006.01)

(52) U.S. Cl.
CPC ..... *F04B 11/005* (2013.01); *F04B 2201/00* (2013.01); *F04B 2203/02* (2013.01); *F04B 2205/00* (2013.01); *F04B 2201/12* (2013.01)
USPC ..... 417/53

(58) Field of Classification Search
CPC ..... F04B 11/005
USPC ..... 417/44.1, 44.2, 44.11, 46, 53
See application file for complete search history.

(56) References Cited

U.S. PATENT DOCUMENTS

| | | | | |
|---|---|---|---|---|
| 5,114,314 | A | | 5/1992 | Fujimoto |
| 5,145,339 | A | | 9/1992 | Lehrke et al. |
| 5,695,720 | A | * | 12/1997 | Wade et al. ..... 422/82 |
| 5,737,994 | A | | 4/1998 | Escobosa |
| 5,755,559 | A | | 5/1998 | Allington et al. |
| 6,024,060 | A | | 2/2000 | Buehrle, II et al. |
| 6,264,431 | B1 | | 7/2001 | Triezenberg |
| 6,353,303 | B1 | | 3/2002 | Ramachandran et al. |
| 6,464,464 | B2 | | 10/2002 | Sabini et al. |
| 6,494,685 | B2 | | 12/2002 | Carstensen |
| 6,652,239 | B2 | | 11/2003 | Carstensen |
| 2002/0141875 | A1 | | 10/2002 | Carstensen |
| 2002/0197166 | A1 | | 12/2002 | Carstensen |
| 2003/0091443 | A1 | | 5/2003 | Sabini et al. |
| 2004/0151594 | A1 | | 8/2004 | Allington et al. |
| 2005/0123408 | A1 | | 6/2005 | Koehl |

FOREIGN PATENT DOCUMENTS

WO WO 02/46612 A1 6/2002

* cited by examiner

*Primary Examiner* — Anh Mai
*Assistant Examiner* — Hana Featherly
(74) *Attorney, Agent, or Firm* — Kinney & Lange, P.A.

(57) ABSTRACT

A two (or more) piston pump system (10) is provided with both pumps (12) being crank (14) driven. The system does not have a mechanical camshaft, but a software algorithm, which acts like one in controller (20). The algorithm will LEARN and create a unique speed profile, which will mimic the mechanical camshaft. For practical purposes the speed profile of output gear is called Cam profile with software acting as an imaginary camshaft. The algorithm utilizes Crank Angle Estimation, Learn Curve Generation, Smoothing and Advance Timing Calculation.

4 Claims, 4 Drawing Sheets

ELECTRONIC CAMSHAFT MOTOR CONTROL FOR PISTON PUMP

TECHNICAL FIELD

This application claims the benefit of U.S. Application Ser. No. 60/826,997, filed Sep. 26, 2006.

BACKGROUND ART

Various pumps have been utilized over the years to circulate paint and similar materials through a system. While air-operated reciprocating piston pumps have long been popular for this use, there has been an increased desire to migrate to more efficient electric powered solutions. Electric powered centrifugal pumps, progressive cavity pumps and screw drive reciprocating piston pumps (U.S. Pat. No. 5,725,358) have all been commercialized. Whichever technology is utilized, it is desired to minimize pulsation so that a constant system pressure is present. Multiple reciprocating piston pump systems (Graco Inc.'s GM10000 airless sprayer, published PCT application WO 02/46612 A1 and U.S. Pat. No. 5,145,339) have been made wherein the pumps are offset in phase so as to minimize pulsation.

DISCLOSURE OF THE INVENTION

A two (or more) piston pump system is provided with both pumps being crank driven and offset by about 84° in the preferred embodiment. The system does not have a mechanical camshaft, but a software algorithm, which acts like one. The algorithm will LEARN and create a unique speed profile, which will mimic the mechanical camshaft. For practical purposes the speed profile of output gear is called Cam profile with software acting as an imaginary camshaft. The algorithm utilizes Crank Angle Estimation, Learn Curve Generation, Smoothing and Advance Timing Calculation A Smooth CAM speed profile is developed in three steps: (1) Theoretical Cam speed profile is derived; (2) a pump-unique profile is Learned; and (3) Practical Cam profile is developed.

Theoretical Cam speed profile consists of 360 points (one point per degree). It is derived to deliver constant flow and pressure through the outlet of the system's manifold. The following parameters are used for calculations: degree of displacement of pistons, volume of the piston rod, which effects the real pump volume on the upstroke, change-over duration, at which time no liquid is pumped, and geometries of connecting rod and pump bore.

A unique set of formulas is used to practically develop a perfect Cam profile for a given system, which insures constant pressure and flow from the pump. The Learn algorithm also allows the pump to learn the pressure variations while operating.

Once Learned Cam is developed, it is overlaid over the Theoretical Cam and Practical Cam is developed. Note that Theoretical Cam modeling is only approximation, as it is extremely difficult to model effects of check balls and general flexing of the gearbox and pump assemblies. Learned Cam takes into account 100% of variables and therefore it is system specific. Timing of changeovers and ball checks of the Theoretical Cam are verified against Learned Cam. Accelerations and decelerations of the Learned Cam are also verified against theoretical values and are capped at ±30%. Small, sharp spikes in speed, which were caused by unexplained rapid changes in pressure, are eliminated.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
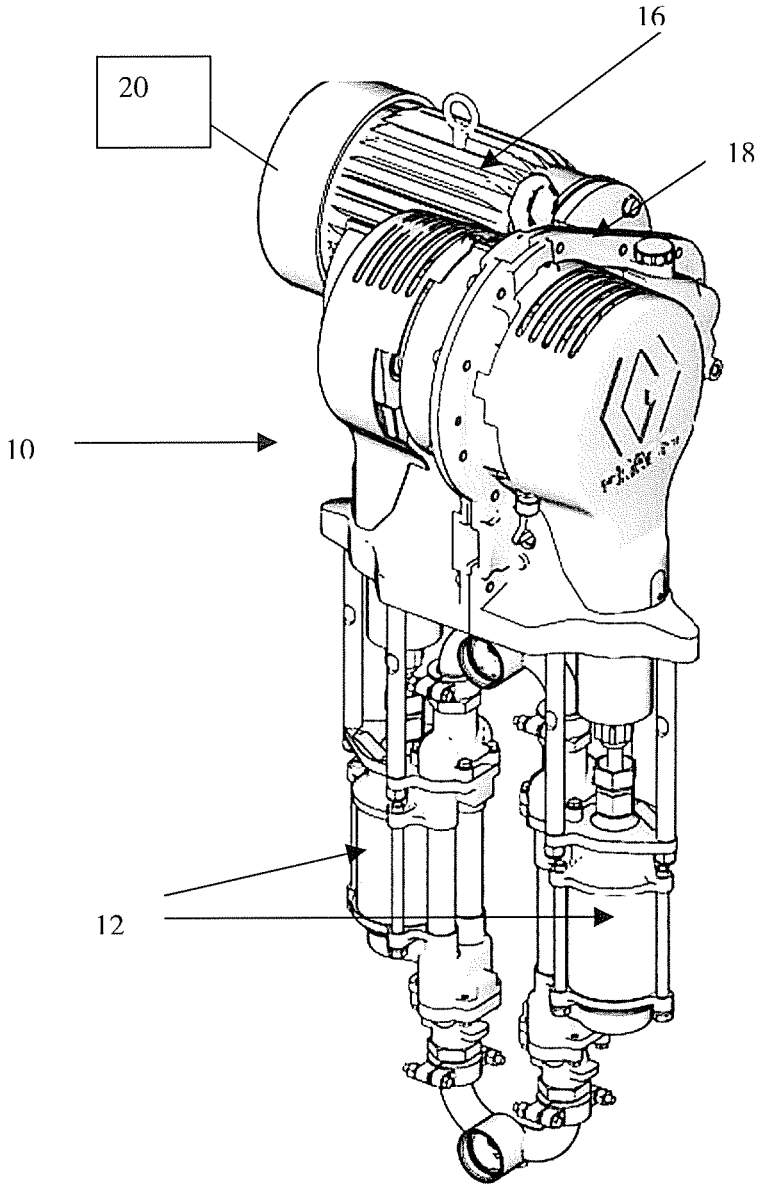
FIG. 1 is an overall view of a pump system utilizing the instant invention.

A two (or more) piston pump system 10 is shown generally in FIG. 1. System 10 is provided with two pumps 12 which are crank 14 driven their respective cranks 14 being offset by about 84° in the preferred embodiment. An electric motor 16 drives a gear reduction unit 18 which in turn drives cranks 14. The system 10 does not have a mechanical camshaft, but a software algorithm, which acts like one. The algorithm will LEARN and create a unique speed profile, which will mimic the mechanical camshaft. For practical purposes the speed profile of output gear is called Cam profile with software acting as an imaginary camshaft. The algorithm utilizes Crank Angle Estimation, Learn Curve Generation, Smoothing and Advance Timing Calculation A Smooth CAM speed profile is developed in three steps: (1) Theoretical Cam speed profile is derived; (2) a pump-unique profile is Learned; and (3) Practical Cam profile is developed.

Theoretical CAM speed profile consists of 360 points (one point per degree). It is derived to deliver constant flow and pressure through the outlet of the system's manifold. The following parameters are used for calculations: degree of displacement of pistons, volume of the piston rod, which effects the real pump volume on the upstroke, change-over duration, at which time no liquid is pumped, and geometries of connecting rod and pump bore.

A unique set of formulas is used to practically develop a perfect CAM profile for a given system, which insures constant pressure and flow from the pump. The LEARN algorithm also allows the pump to learn the pressure variations while operating.

Once LEARNED CAM is developed, it is overlaid over the Theoretical CAM and Practical Cam is developed. Note that Theoretical CAM modeling is only approximation, as it is extremely difficult to model effects of check balls and general flexing of the gearbox and pump assemblies. LEARNED CAM takes into account 100% of variables and therefore it is system specific. Timing of changeovers and ball checks of the Theoretical CAM are verified against LEARNED CAM. Accelerations and decelerations of the LEARNED CAM are also verified against theoretical values and are capped at ±30%. Small, sharp spikes in speed, which were caused by unexplained rapid changes in pressure, are eliminated.

The system does not have a mechanical camshaft, but a software algorithm, which acts like one. The algorithm will LEARN and create a unique speed profile, which will mimic the mechanical camshaft. For practical purposes the speed profile of output gear is called CAM profile with software acting as an imaginary camshaft. The algorithm utilizes the following unique features:

Crank Angle Estimation

Learn Curve Generation

Smoothing

Advance Timing Calculation

LEARN CAM algorithm eliminates the need for an encoder by performing angle estimation. One Top Dead Center (TDC) sensor is installed in a gearbox. The sensor is looking at a mark on an output gear. This mark triggers the sensor once every revolution. As soon as sensor is triggered, the algorithm starts calculating degree of gear rotation as follows:

1. Number of Estimated Motor Revolutions per one 4 ms time frame are found first.

2. Estimated Angle of output gear rotation is found based on the Number of Estimated Motor Revolutions.

The software code is installed in a 4 ms processor task, which executes every 4 ms. It means that code looks at motor frequency once every 4 ms. Note that actual execution time depends on the amount of code in the task; therefore we cannot assume that our time frame is exactly 4 ms long. Software needs provisions to adjust for the error.

The following formulas describe technique used to calculate angle of rotation:

$$Ns = \frac{120 * F}{P}\left[\frac{\text{Revolutons}}{\text{Minute}}\right]$$

Where $Ns$-Speed, $F$-Frequency, $P$-Number or Poles

Convert to Revolutions per Second:

$$Ns = \frac{\frac{120 * F}{4}\left[\frac{\text{Revolutions}}{\text{MInute}}\right]}{60\ \text{Seconds}} = \frac{F}{2}\left[\frac{\text{Revolutions}}{\text{Second}}\right];$$

Find revolutions per one 4 ms time frame:

$$\frac{\text{Revolutions}}{4\ \text{ms Task}} = \frac{F}{2};$$

$$\text{Therefore: Estimated Motor Revolutions} = \frac{F * 4\ \text{ms Task}}{2}$$

Gear Box Speed Ratio=75, which means that every 75 revolutions of the motor we have one revolution of the camshaft:

$$1\ CAM\ \text{Revolution} = 75\ \text{Motor Revolutions}$$

$$\frac{360°_\text{of}_\text{CAM}}{75_\text{Motor}_\text{Revolutions}} = 4.8°\left[\frac{\text{Degree}_\text{of}_\text{CAM}_\text{Revolution}}{1_\text{Motor}_\text{Revolution}}\right];$$

This means that 1 motor revolution results in 4.8° of output gear revolution.

Motor revolutions are tracked based on time (4 ms Task Time), therefore camshaft angle can be found at any given number of motor revolutions:

$$360°\ \text{of}\ CAM = 75\ \text{Motor Revolutions}$$

$$X°\ \text{of}\ CAM = \#\ \text{of Estimated Motor Revolutions}$$

$$\text{Therefore: } X° = \frac{360° * (\text{Estimated}_\text{Motor}_\text{Revolutions})}{75}$$

$$\Rightarrow \text{Esimated Angle of } CAM = \frac{360° * (\text{Estimated}_\text{Motor}_\text{Revolutions})}{75};$$

The system uses speed array of 360 points. Each point represents an angle of crankshaft (output gear) rotation. At the start of the LEARN process, the array is empty with all of its cells filled with zeros. The LEARN process, once started, activates closed loop control system, input of which is pressure of a liquid being pumped, and output is a motor speed. In simplified terms, the system works to deliver constant pressure by adjusting speed of the motor, while recording speed values at every angle of rotation for future use when not in LEARN.

For example, assume that current angle of rotation is 18°, and measured pressure (current pressure) at this angle is 180 PSI. Assume that average pressure is 150 PSI. The current pressure is 20% above average. That is the pressure fluctuation, which needs to be eliminated. The system then will adjust speed of the motor by approximately −20% for 18° point to eliminate pressure fluctuation and bring current pressure closer to the average pressure. The process lasts 13 camshaft revolutions, which essentially means that every point is adjusted 13 times. Each time the error will be narrowed to bring pressure at 18° angle closer to the average pressure.

Key control system elements are:

Current Pressure—Fluid pressure signal is updated every 10 ms

Figure 2:
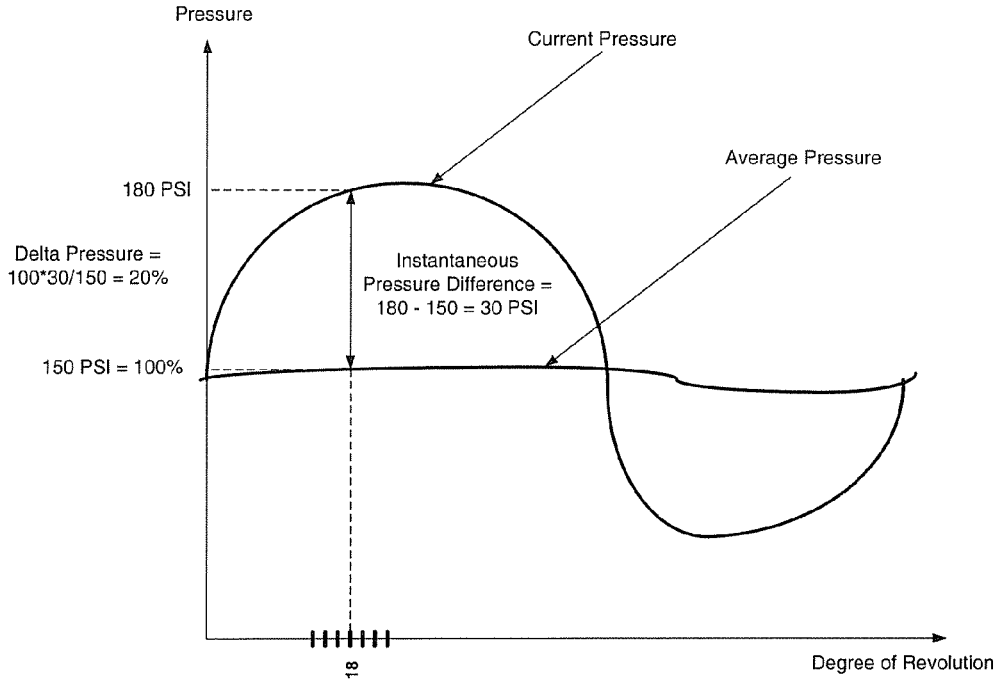
FIG. 2 illustrates Current Pressure, Average Pressure, Instantaneous Pressure Difference and Current Pressure as a function of degree of revolution.

Average Pressure—Average pressure is derived with the help of First Order filter function with time constant of 2.4 seconds. For practical purposes, the filtered function can be referred to as a simple averaging function Instantaneous Pressure Difference—Instantaneous Pressure Difference Current Pressure—Average Pressure Delta Pressure—Delta pressure is a percent relationship of Instantaneous Pressure Difference to Average Pressure. Refer to FIG. 2.

Smoothing—is a process of slow error elimination. From FIG. 2 it is seen that error at 18° is 20%. To prevent overcorrection and extra stress on the motor, the error is not corrected by simply increasing motor speed by 20%, which would cause motor to pump more fluid and therefore develop 20% more pressure to compensate for the error. Note that there is square root relationship between pressure and flow. 20% increase in motor speed would only increase pressure by square root of 20%. Instead, the error is eliminated gradually by small increments in speed during 13 LEARN revolutions. First four revolutions the smoothing factor is equaled to 5, next four revolutions the factor is 4, the next four the factor is 3, and the last revolution the factor is 2. The factor represents amount of added weight to the value of degree of revolution.

For example, if LEARN is on its third revolution, the smoothing factor is equaled to 5. The algorithm will take values of previous 5 angles (13°, 14°, 15°, 16°, and 17°) and values of the angles following the current angle (19°, 20°, 21°, 22°, and 23°). The current algorithm will then find average of all of these values, while adding current angle 18° value twice, so it has more weight. The resulted speed value is assigned to angle 18°.

LEARN CAM Algorithm has provisions to adjust for the error associated with control system response delay and motor slippage. The algorithm will calculate the delay based on the motor frequency and a special constant, LEARN LEAD ANGLE. The constant is motor slippage dependant and is derived by test.

$$\text{Learn Angle} = \text{Current Angle} + \text{Learn Lead};$$

$$\text{Learn Lead} = \text{LEARN LEAD ANGLE} * \frac{\text{Motor_Frequency}}{\text{Frequency_Divider}};$$

$$\text{Frequency Divider} = 60;$$

Example: Assume that estimated angle (Current Angle) is 18°, and motor frequency corresponding to this angle is 20 Hz. Assume Learn Lead to be −6.

$$\text{Learn Lead} = 18° + (-6) * \frac{20\ \text{Hz}}{60\ \text{Hz}} = 16°$$

Figure 3:
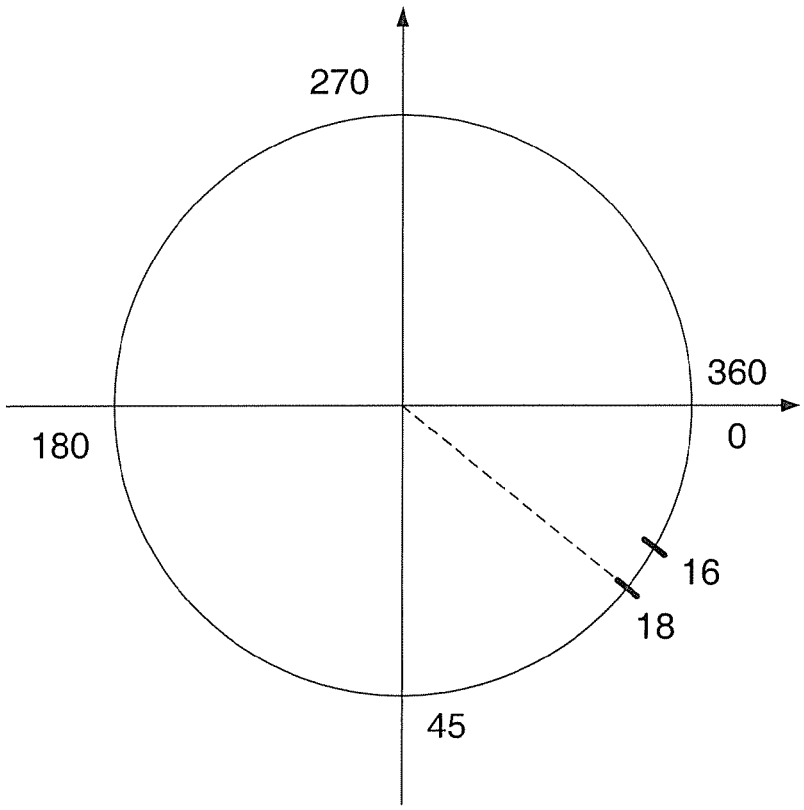
FIG. 3 shows the advance timing technique as applied to Output Gear Rotation.
Figure 4:
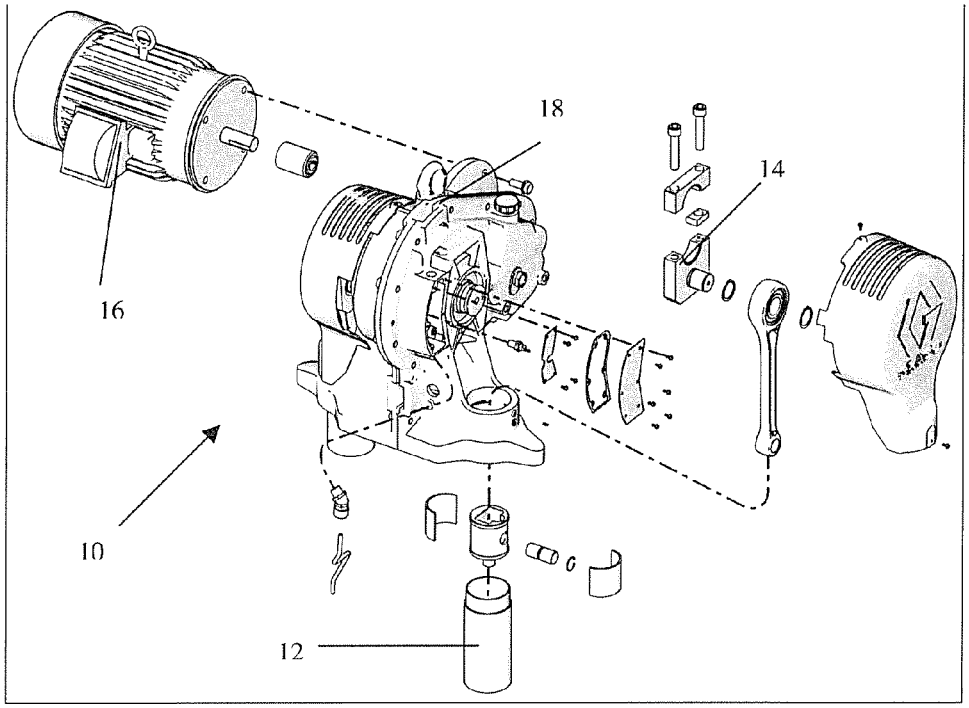
FIG. 4 shows an exploded view of the pump drive.

When LEARN is in process of calculating error, it attaches it to a Learn Angle and not the Current Angle. If output gear is at 18° and error is at +20%, the LEARN algorithm through its SMOOTHING will determine motor speed correction. Assume that correction was found to be −17.5%. Without ADVANCE TIMING, the LEARN algorithm would command motor speed to be −17.5% when output gear would reach 18° of rotation. This means that the motor speed would have to be adjusted instantly by −17.5%. In a real world it is impossible. Control system needs processing time and motor needs time to react to the command. ADVANCE TIMING ensures that this command is sent to the motor in advance. In this example advance is −2°, so the algorithm would command −17.5% change in speed when output gear reaches 16°, and not 18°, therefore giving system time to respond. Refer to FIG. 3.

It is contemplated that various changes and modifications may be made to the pump control without departing from the spirit and scope of the invention as defined by the following claims.

The invention claimed is:

1. A piston pump system comprising:

at least two crank driven reciprocating pumps, the cranks of said pumps being offset;

an electric motor for driving the said at least two pumps; and a controller for controlling the operation of said pumps by causing the electric motor to drive the pumps according to a motor speed profile that mimics a mechanical camshaft, wherein the motor speed profile is based upon:

a theoretical cam speed profile for said pumps that takes into account more than one of the parameters of degree of displacement of pistons, volume of the piston rod, change-over duration and geometries of connecting rod and pump bore;

a pump unique profile learned by operating said pump system to produce a learned cam speed profile; and a practical cam speed profile produced by overlaying said theoretical cam speed profile with said learned cam speed profile.

2. The piston pump system as claimed in claim 1, wherein the cranks of the said pumps are offset by approximately 84°.

3. A piston pump system comprising:

at least two crank driven reciprocating pumps, cranks of said pumps being offset;

an electric motor for driving the said at least two pumps; and a controller for controlling operation of the electric motor according to a motor speed profile that mimics a mechanical camshaft, wherein the controller develops the motor speed profile by:

(a) operating said pump system at a constant speed and collecting output pressure data at a selection of crank angle positions;

(b) forming a pressure profile from said output pressure data collection;

(c) inverting said pressure profile to form a motor speed profile which will reduce pressure variation; and (d) repeating the above steps (a)-(c) at least once in an iterative process until pressure variation does not exceed a predetermined amount.

4. The piston pump system as claimed in claim 3, wherein the controller is further configured to monitor pressure variation during operation and adjust said motor speed profile to reduce pressure variation in the event said predetermined amount is exceeded.

* * * * *